US008836198B2

(12) United States Patent
Yu et al.

(10) Patent No.: US 8,836,198 B2
(45) Date of Patent: Sep. 16, 2014

(54) BRUSH HOLDER OF SLIP RING

(75) Inventors: Meng-Chiu Yu, Taichung (TW); Su-Chen Liao, Taichung (TW)

(73) Assignee: Taiwan Long Hawn Enterprise Co., Taichung (TW)

( * ) Notice: Subject to any disclaimer, the term of this patent is extended or adjusted under 35 U.S.C. 154(b) by 430 days.

(21) Appl. No.: 13/226,754

(22) Filed: Sep. 7, 2011

(65) Prior Publication Data

US 2013/0057109 A1 Mar. 7, 2013

(51) Int. Cl.
*H01R 39/41* (2006.01)
*H01R 39/39* (2006.01)
*H01R 39/38* (2006.01)

(52) U.S. Cl.
CPC ..... *H01R 39/39* (2013.01); *H01R 39/385* (2013.01)
USPC ..... 310/244; 310/242

(58) Field of Classification Search
CPC ..... H01R 39/39; H02K 5/145; H02K 5/146
USPC ..... 310/230–248, 143, 147, 148
See application file for complete search history.

(56) References Cited

U.S. PATENT DOCUMENTS 3,234,420 A * 2/1966 Lindner ..... 310/244
4,574,215 A * 3/1986 Mabuchi ..... 310/239
4,638,204 A * 1/1987 Kirchner et al. ..... 310/239
4,873,464 A * 10/1989 Wang ..... 310/249
4,893,043 A * 1/1990 Baines ..... 310/239
4,900,966 A * 2/1990 Winter et al. ..... 310/239
4,994,701 A * 2/1991 Bulick ..... 310/239
5,013,952 A * 5/1991 Sekine et al. ..... 310/239
5,140,205 A * 8/1992 Baines ..... 310/68 C
5,294,852 A * 3/1994 Straker ..... 310/68 C
5,550,418 A * 8/1996 Chung ..... 310/239
5,648,695 A * 7/1997 Yamaguchi et al. ..... 310/242
5,939,812 A * 8/1999 Wetzel ..... 310/245
6,603,235 B1 * 8/2003 Kimura ..... 310/239
7,005,774 B2 * 2/2006 Kuribayashi et al. ..... 310/244
7,466,056 B2 * 12/2008 Golab et al. ..... 310/245
7,723,893 B2 * 5/2010 West et al. ..... 310/244
2009/0284098 A1 * 11/2009 Sesselmann ..... 310/242
2011/0115331 A1 * 5/2011 Yu et al. ..... 310/246

* cited by examiner

*Primary Examiner* — Quyen Leung
*Assistant Examiner* — Naishadh Desai
(74) *Attorney, Agent, or Firm* — Tracy M. Heims; Apex Juris, pllc

(57) ABSTRACT

A brush holder of the present invention is formed by a plurality of brush holder units in serial connection. Each brush holder unit includes an insulating base, a brush frame, and two carbon brushes. The insulating base has a protrusion and a recess on opposite sides. The brush frame has a main body received in the recess and two branches projected from opposite ends of the main body. The carbon brushes are provided on the branches of the brush frame. The protrusion of the brush holder unit is inserted into the recess of another brush holder unit to serially connect the brush holder units as well as to secure the brush frame in the recess. Therefore, the brush holder may be formed by serially connecting the brush holder units in a fast and easy way, and it provides a stable signal transmission.

18 Claims, 8 Drawing Sheets

BRUSH HOLDER OF SLIP RING

BACKGROUND OF THE INVENTION

1. Field of the Invention

The present invention relates generally to an electro-machine system, and more particularly to a brush holder of a slip ring.

2. Description of the Related Art

When an electro-mechanical system, such as electric machine or power generator, is running, a slip ring serves the function of electrical signal transmission between a running device and a static device to input/output signals and to change the direction. The slip ring has several advantages including raising the system's performance, simplifying the structure, and avoiding the wire from being breaking when the system is running.

Typically, the slip ring is provided with carbon brushes for signal transmission. FIG. 1 shows a conventional brush holder of the slip ring on which the carbon brushes are provided. The brush holder includes a substrate 60 and a plurality of brush frames 70. The substrate 60 has a conductor pattern 62 thereon, and each brush frame 70 is provided with two carbon brushes 72 on opposite ends. The brush frames 70 are fixed on a bottom side of the substrate 60 by welding and are electrically connected to the conductor pattern 62 that the carbon brushes 72 are electrically connected to wires 75 through the conductor pattern 62. User may control the connection between the carbon brushes 72 and the wires 75 through the conductor pattern 62. However, the conductor pattern 62 of the substrate 60 is very complex that it costs much to design and manufacture the substrate 60.

To improve the above drawback, an improved brush holder of a slip ring was provided. As shown in FIG. 2, the brush holder includes a substrate 80 and a plurality of brush frames 90. The substrate 80 is provided with a plurality of bores 82. Each brush frame 90 is provided with a bore 92 at middle that a bolt 85 is inserted into the bores 92, 82, and then engages a nut 86 to fix the brush frames 90 on a bottom side of the substrate 80. Wires 95 are connected to the bolts 85 respectively that user may control the signal transmission through the bolts 85 and the wires 95. This design has the advantages of low cost and fast manufacture. However, the bolt 85 and the nut 86 will be loose or get rust after a time of use that the electrical signal transmission will become unstable.

Besides, aforesaid slip rings have a fixed size that the specific brush holder has a fixed number of brush frames, and only may be mounted in a specific slip ring. For a slip ring with different numbers of brush frames, the substrate and the conductor pattern thereon have to be redesigned. Therefore, it still has some places that need to be improved in the conventional slip ring.

SUMMARY OF THE INVENTION

The primary objective of the present invention is to provide a brush holder of a slip ring, which may be assembled in a fast way, and has a low cost and stable electrical signal transmission, and furthermore, it may change its size according to the requirement.

According to the objective of the present invention, a brush holder of a slip ring includes a plurality of brush holder units in serial connection. Each brush holder unit includes an insulating base, a brush frame, and two carbon brushes. The insulating base is an insulator, having a protrusion and a recess on opposite sides, and further having two slots, each of which has an end connected to opposite ends of the recess and an opposite end at an edge of the insulating base. The brush frame is a conductor, having a main body and two branches projected from opposite ends of the main body. The main body is received in the recess of the insulating base, and the branches extend out of the insulating base through the slots. The carbon brushes are provided on the branches of the brush frame.

The protrusion of the brush holder unit is inserted into the recess of another brush holder unit to press the main body of the brush frame on a sidewall of the recess and to serially connect the brush holder units.

Therefore, the brush holder may be formed by serially connecting the brush holder units in a fast and easy way, and it provides a stable signal transmission.

DETAILED DESCRIPTION OF THE INVENTION

Figure 2:
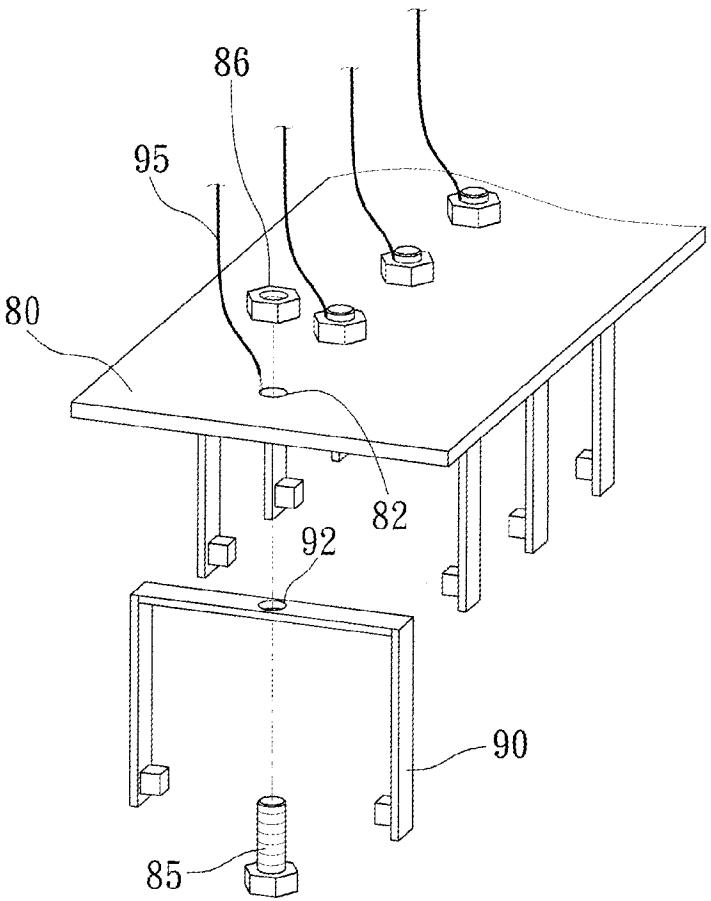
FIG. 2 (PRIOR ART)
FIG. 2 is perspective view of another conventional brush holder of the slip ring.
Figure 1:
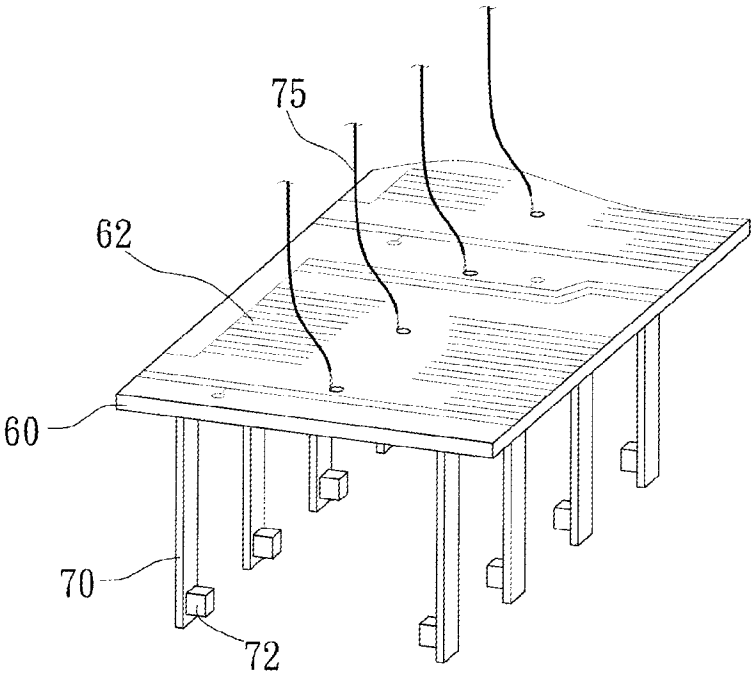
FIG. 1 (PRIOR ART)
FIG. 1 is a perspective view of the conventional brush holder of the slip ring.
Figure 4:
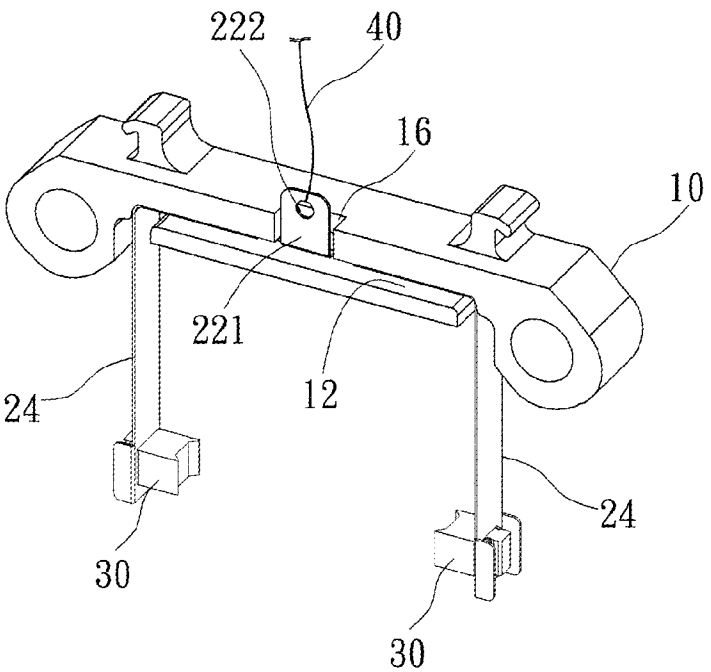
FIG. 4 is a perspective view of the brush holder unit of the preferred embodiment of the present invention.
Figure 3:
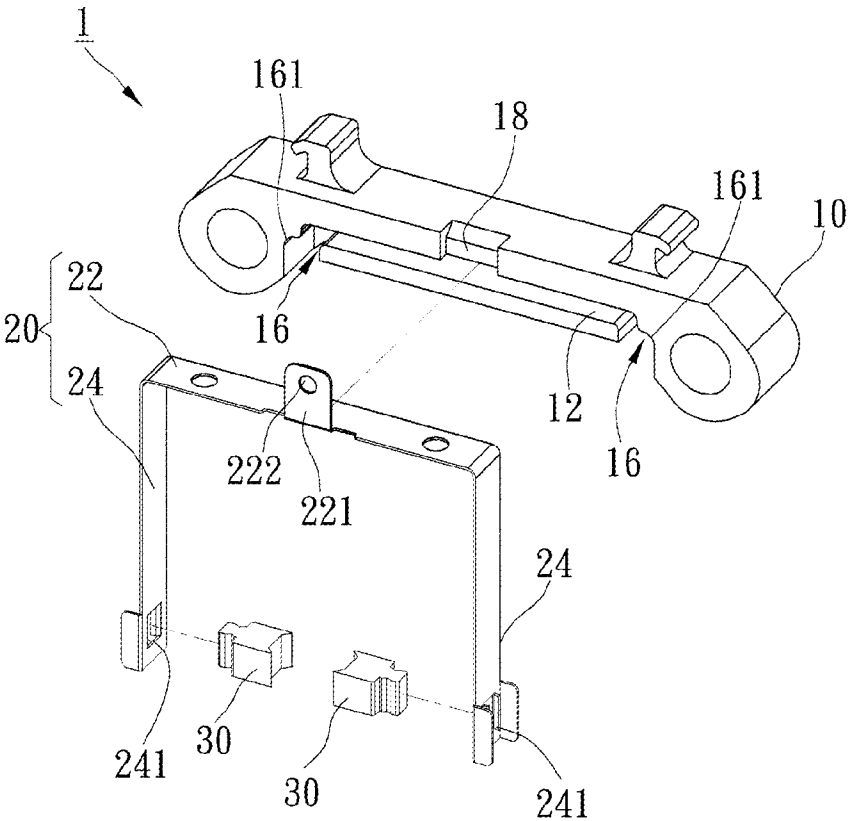
FIG. 3 is an exploded view of the brush holder unit of a preferred embodiment of the present invention.
Figure 5:
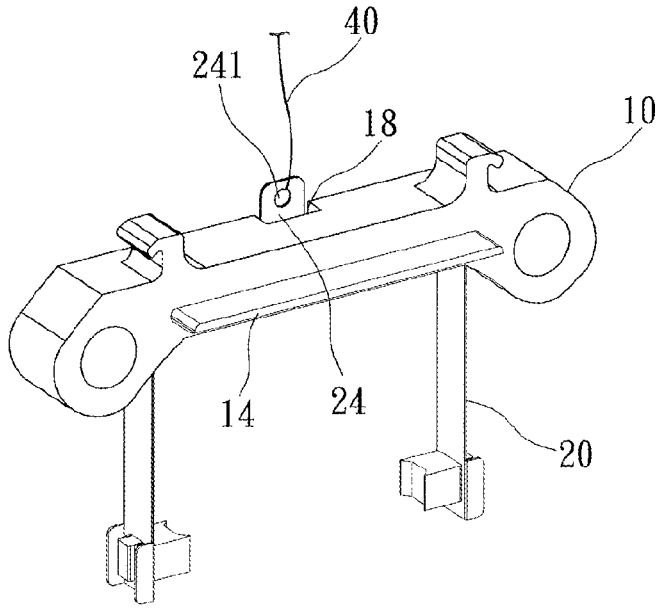
FIG. 5 is another perspective view of the brush holder unit of the preferred embodiment of the present invention.

A brush holder of a slip ring of the preferred embodiment of the present invention is formed by a plurality of brush holder units 1 in serial connection. As shown in FIG. 3 to FIG. 5, each brush holder unit 1 includes an insulating base 10, a brush frame 20, and two carbon brushes 30.

The insulating base 10 is made of an insulating material. The insulating base 10 has a recess 12 and a protrusion 14 at opposite sides. The insulating base 10 further has two slots 16 which are vertical to the recess 12 and connected to opposite ends of the recess 12.

Figure 6:
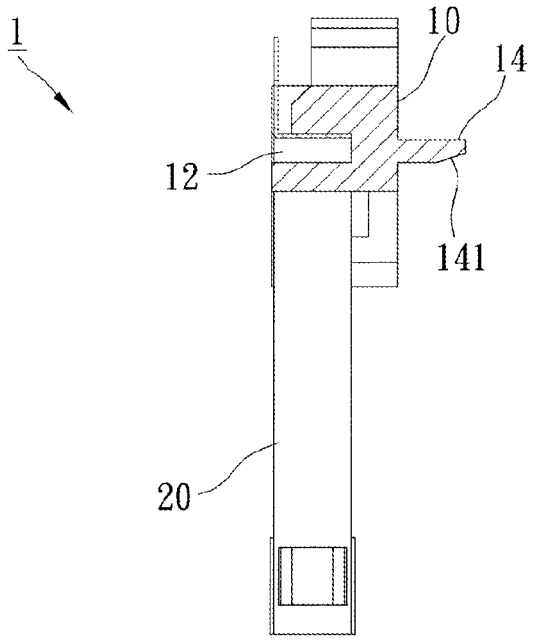
FIG. 6 is a sectional view of the brush holder unit of the preferred embodiment of the present invention.
Figure 7:
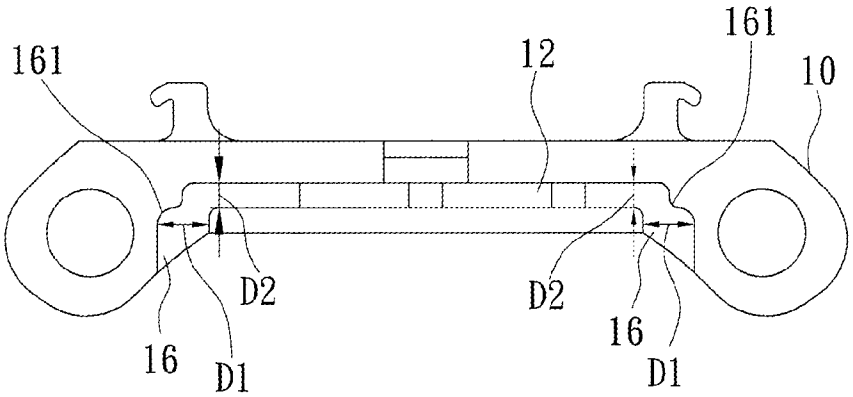
FIG. 7 is a front view of the insulating base of the brush holder unit of the preferred embodiment of the present invention, showing the screw bar.

The recess 12 is a transverse and elongated slot. The insulating base 10 further has an indentation 18 above the recess 12 and communicated with the recess 12. As shown in FIG. 6, the protrusion 14 is a transverse and elongated block with an inclined face 141 adjacent to a top thereof that a thickness at the top of the protrusion 14 is smaller than a thickness at a bottom. As shown in FIG. 7, each slot 16 has a first end at an edge of the insulating base 10, and a second end, which is opposite to the first end, connected to the recess 12. Each slot 16 has a concave sidewall 161 at the first end that the first end is wider than the second end, i.e., a width D1 at the first end is greater than a width D2 at the second end.

The brush frame 20 is made of a conductive material. The brush frame 20 is a U-shaped flat piece having a main body 22 and two branches 24 at opposite ends of the main body 22. The brush frame 20 has a connector 221 projected upwards from the main body 22. The connector 221 has a hole 222 that a wire 40 may be fastened to the connector 221. The main body 22 of the brush frame 20 is received in the recess 12 of the insulating base 10 that the conductor 221 is received in the indentation 18 and the branches 24 extend out of the insulating base 10 through the slots 16 respectively. Each branch 24 has a hole 241 adjacent to a distal end thereof to secure the carbon brush 30. Without the substrate, the conductor pattern, and the bolt, the brush frame 20 of the present invention may transmit signals from the wire 40 to the carbon brushes 30 or from the carbon brushes 30 to the wire 40 to provide a stable signal transmission.

Figure 8:
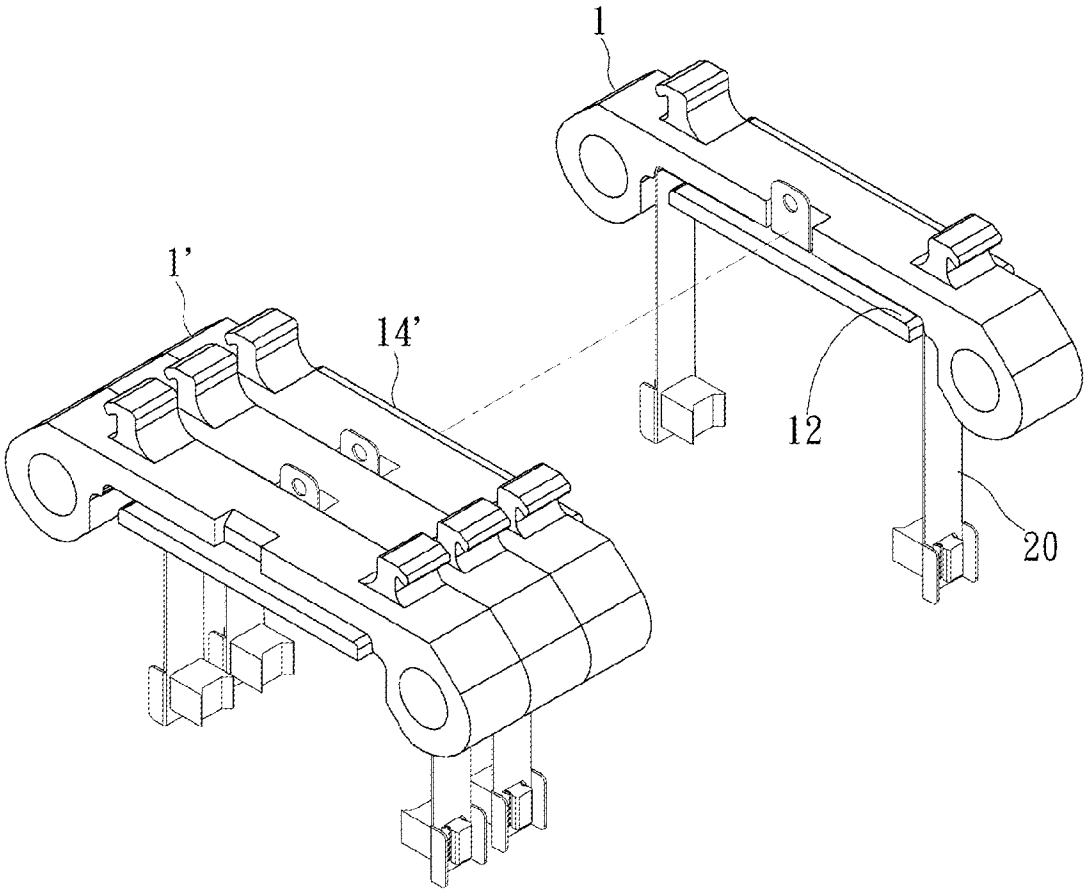
FIG. 8 is a perspective view of the preferred embodiment of the present invention, showing the brush holder units in serial connection to form the brush holder.
Figure 9:
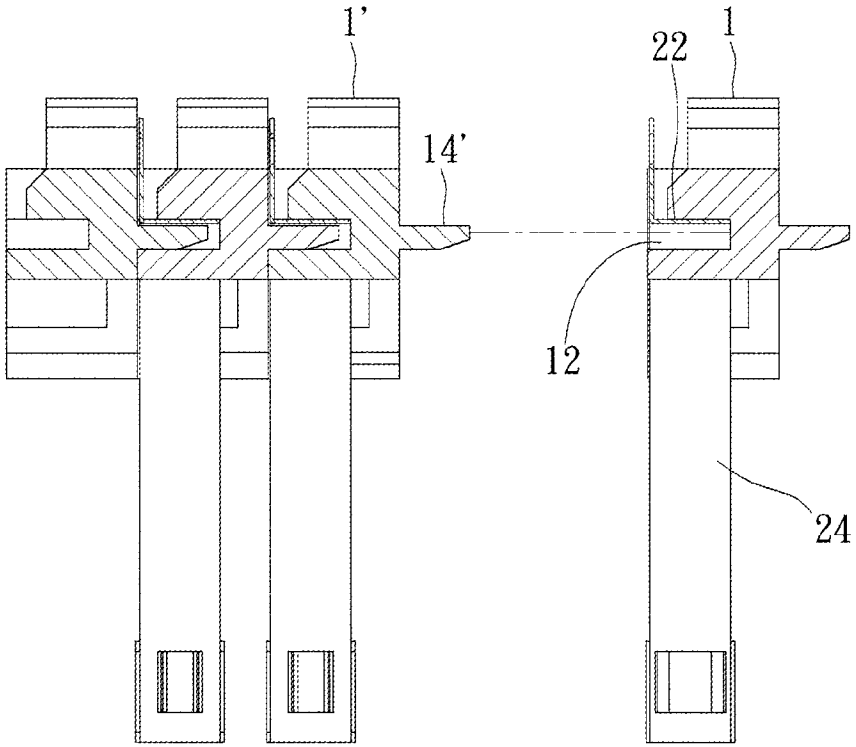
FIG. 9 is a sectional view of the brush holder units in serial connection of the preferred embodiment of the present invention.

As shown in FIG. 8 and FIG. 9, user may serially connect the brush holder units 1 of the present invention together to form the brush holder. To connect the brush holder unit 1 to another brush holder unit 1', the protrusion 14' of the brush holder unit 1' is squeezed into the recess 12 of the brush holder unit 1 to connect the brush holder units 1 and 1' as well as to press the main body 21 of the brush frame 20 on a sidewall of the recess 12. The tapered protrusion 14' may help the engagement and disengagement of the protrusion 14' and the recess 12 in a fast and easy way.

Figure 10:
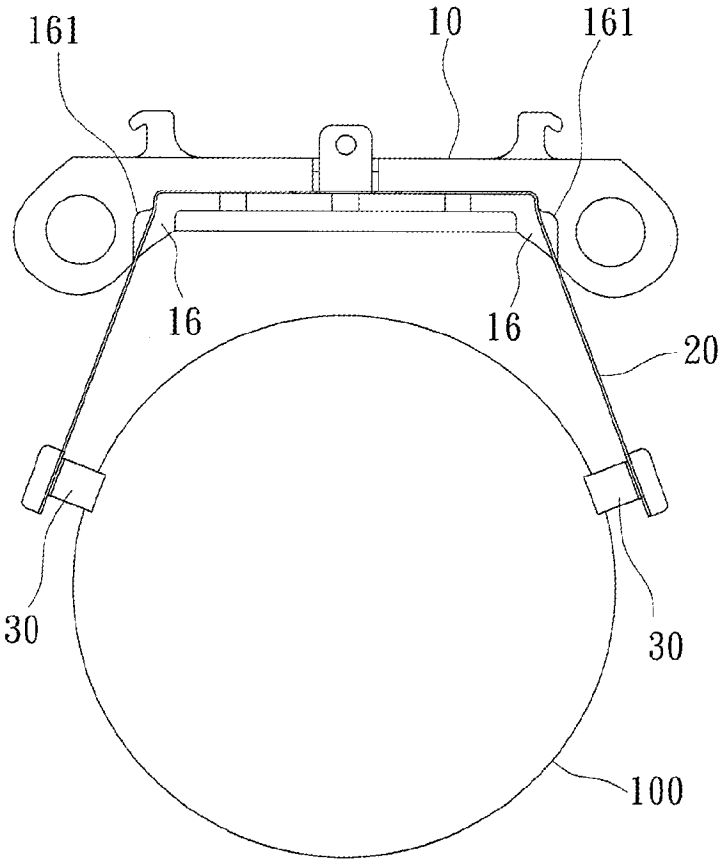
FIG. 10 is a sketch diagram, showing the brush holder and the slip ring.

As shown in FIG. 10, when the slip ring 100 transmits electrical signals through the brush holder unit 1 of the present invention, the carbon brushes 30 touch the slip ring 100. The slip ring 100 extends the branches 24 of the brush frame 20 outwardly that the branches 24 of the brush frame 20 urges the carbon brushes 30 against the slip ring 100. The concave sidewalls 161 in the slots 16 provide spaces to extend the branches 24, and it provides the brush frame 20 stably against the sidewall of the slots 16 that the brush frame 20 is firmly secured in the recess 12 of the insulating base 10 without any movement.

Figure 11:
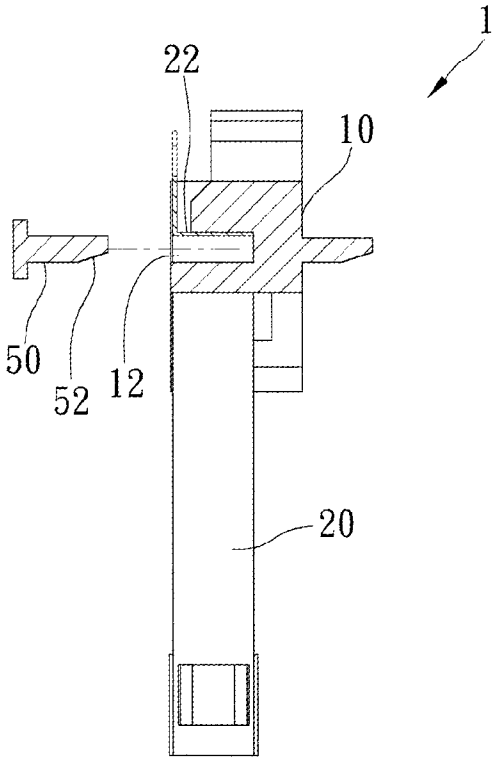
FIG. 11 is a sectional view, showing the plug for securing the brush frame.

As shown in FIG. 11, the present invention further provides a plug 50, which is made of an insulating material, to be inserted into the recess 12 of the last brush holder unit 1, in which no protrusion 14 of another brush holder unit 1 is inserted into the recess 12, to secure the brush frame 20. The plug 50 is the same as the protrusion 14, having an inclined face 52 to engage and disengage the recess 12 in a fast and easy way.

The description above is a few preferred embodiments of the present invention. Any structure that involves the engagement of several brush holder units to form the brush holder should be in the scope of the present invention. These equivalences of the present invention are still in the scope of claim construction of the present invention.

What is claimed is:

1. A brush holder unit, comprising:

an insulating base, which is made of an insulating material, having a protrusion and a recess on opposite sides, and further having two slots, each of which has an end connected to opposite ends of the recess and an opposite end at an edge of the insulating base;

a brush frame, which is made of a conductive material, having a main body and two branches projected from opposite ends of the main body, wherein the main body is received in the recess of the insulating base, and the branches extend out of the insulating base through the slots; and two carbon brushes provided on the branches of the brush frame;

wherein each of the slots of the insulating base has a first end at the edge of the insulating base and a second end connected to an end of the recess, and a width at the first end is greater than a width at the second end; and wherein the slot has a concave sidewall at the first end that the width at the first end is greater than the width at the second end.

2. The brush holder unit as defined in claim 1, wherein the insulating base further has an indentation communicated with the recess, and the brush frame further has a connector on the main body that the connector of the brush frame is received in the indentation of the insulating base when the main body is received in the recess.

3. The brush holder unit as defined in claim 2, wherein the connector of the brush frame has a hole, and a wire is fastened to the hole.

4. The brush holder unit as defined in claim 1, wherein a thickness at a bottom of the protrusion of the insulating base is greater than a thickness at a top of the protrusion.

5. The brush holder unit as defined in claim 4, wherein the protrusion has an inclined face at the top.

6. The brush holder unit as defined in claim 1, wherein each of the branches of the brush frame has a hole to secure the carbon brush.

7. A brush holder unit, comprising:

an insulating base, which is made of an insulating material, having a protrusion and a recess on opposite sides, and further having two slots, each of which has an end connected to opposite ends of the recess and an opposite end at an edge of the insulating base;

a brush frame, which is made of a conductive material, having a main body and two branches projected from opposite ends of the main body, wherein the main body is received in the recess of the insulating base, and the branches extend out of the insulating base through the slots;

two carbon brushes provided on the branches of the brush frame; and a plug inserted into the recess of the insulating base to press the main body of the brush frame on a sidewall of the recess.

8. The brush holder unit as defined in claim 7, wherein the plug has an inclined face at a top thereof.

9. A brush holder of a slip ring, comprising a plurality of brush holder units in serial connection, and each of the brush holder units comprising:

an insulating base, which is made of an insulating material, having a protrusion and a recess on opposite sides, and further having two slots, each of which has an end connected to opposite ends of the recess and an opposite end at an edge of the insulating base;

a brush frame, which is made of a conductive material, having a main body and two branches projected from opposite ends of the main body, wherein the main body is received in the recess of the insulating base, and the branches extend out of the insulating base through the slots; and two carbon brushes provided on the branches of the brush frame;

wherein the protrusion of the brush holder unit is inserted into the recess of another brush holder unit to press the main body of the brush frame on a sidewall of the recess and to serially connect the brush holder units.

10. The brush holder as defined in claim 9, wherein the insulating base further has an indentation communicated with the recess, and the brush frame further has a connector on the main body that the connector of the brush frame is received in the indentation of the insulating base when the main body is received in the recess.

11. The brush holder as defined in claim 10, wherein the connector of the brush frame has a hole, and a wire is fastened to the hole.

12. The brush holder as defined in claim 9, wherein a thickness at a bottom of the protrusion of the insulating base is greater than a thickness at a top of the protrusion.

13. The brush holder as defined in claim 12, wherein the protrusion has an inclined face at the top.

14. The brush holder as defined in claim 9, wherein each of the branches of the brush frame has a hole to secure the carbon brush.

15. The brush holder as defined in claim 9, wherein each of the slots of the insulating base has a first end at the edge of the insulating base and a second end connected to an end of the recess, and a width at the first end is greater than a width at the second end.

16. The brush holder as defined in claim 15, wherein the slot has a concave sidewall at the first end that the width at the first end is greater than the width at the second end.

17. The brush holder as defined in claim 9, further comprising a plug inserted into the recess of the brush holder unit, which has no protrusion of another brush holder unit inserted into the recess thereof, to press the main body of the brush frame on a sidewall of the recess.

18. The brush holder as defined in claim 17, wherein the plug has an inclined face at a top thereof.

* * * * *